United States Patent [19]

Duenke

[11] Patent Number: 4,496,805

[45] Date of Patent: Jan. 29, 1985

[54] TRANSFORMER SWITCH

[75] Inventor: Clarence G. Duenke, San Angelo, Tex.

[73] Assignee: Warco, Inc., Marthasville, Mo.

[21] Appl. No.: 530,867

[22] Filed: Sep. 9, 1983

[51] Int. Cl.[3] ..... H01H 19/58; H01H 21/78

[52] U.S. Cl. ..... 200/11 TC; 200/8 A

[58] Field of Search ..... 200/8 R, 8 A, 9, 10, 200/11 B, 11 J, 11 TC, 14, 17 R, 277

[56] References Cited

U.S. PATENT DOCUMENTS

| | | | |
|---|---|---|---|
| 1,412,002 | 4/1922 | Hendricks, Jr. | 200/8 A |
| 1,725,078 | 8/1929 | Hill | 200/8 R |
| 1,785,575 | 12/1930 | Blume | 200/8 R |
| 2,418,616 | 4/1947 | Batcheller | 200/277 X |
| 2,903,530 | 9/1959 | Wilson, Jr. | 200/11 TC |
| 3,170,048 | 2/1965 | Glatz et al. | 200/11 TC |
| 3,177,307 | 4/1965 | Weber et al. | 200/11 B |
| 3,652,812 | 3/1972 | Ristuccia | 200/11 TC |
| 3,992,595 | 11/1976 | Eley | 200/11 TC |
| 4,160,224 | 7/1979 | Owen | 336/147 |

*Primary Examiner*—J. R. Scott

*Attorney, Agent, or Firm*—Hubbard, Thurman, Turner & Tucker

[57] ABSTRACT

A transformer tap changing switch including a rotary contactor shaft supporting spaced apart radially extending arms having roller contactor sets mounted thereon and yieldably biased into engagement with adjacent ones of an array of elongated cylindrical rod contacts supported between spaced apart switch frame plates. Each of the rod contacts includes a centrally disposed lug or blade type terminal located between the roller contactor assemblies and spaced sufficiently from each such that current flow along the rod contact elements between the terminal portions and the rotary switch contactors establish counteracting magnetic force fields which substantially cancel each other and eliminate any forces acting on the rotary contactor assembly. The switch includes a manually actuated lever for rotating the contactor shaft and which is provided with a switch position locking mechanism including a spring biased pin which projects into a selected hole in a position locking plate member.

17 Claims, 9 Drawing Figures

TRANSFORMER SWITCH

BACKGROUND OF THE INVENTION

1. Field of the Invention

The present invention pertains to a multiple position tap changing switch including a plurality of rod type switch contacts and dual spaced apart roller type contactors for interconnecting the rod contacts and wherein the current flow paths through the contacts substantially balance opposing magnetic forces acting on the movable contactors.

2. Background

There are many applications of electrical transformers wherein a selected range of secondary voltages must be provided for the particular load associated with the transformer. One particularly severe duty application is in connection with transformers used for downhole deepwell electric motor driven pumps. Transformers used for these applications and similar severe duty uses must be provided with tap changing equipment wherein the secondary voltages can be varied to compensate for conductor cable voltage drop between the transformer and the pump, depending on the depth of the well, and changes in the density or viscosity of the fluid being pumped, for example, in applications for pumping crude oil from subterranean deposits. The wide voltage range normally required for transformer applications of the type described above as well as the fact that these transformers are usually situated in remote locations and are subject to frequent changes in secondary or output voltages has placed severe demands on the design of the tap changing switch used to select the voltage applied to the pump motor or other load.

The applications for transformers of the type described above dictate the use of a tap changing or selecting switch which is of the type which ruptures the current directly since the rated currents are usually moderate and mechanical simplicity and economy of manufacture are important considerations in the transformer system. However, in applications such as the deepwell pump application described herein the transformer is serving an induction motor which is started across the line and the transformer secondary circuit can experience current surges in the range of nine to ten times normal current flow. Accordingly, the switch structure must be rugged, capable of reliable snap action movement of the movable contactor between tap positions and offer minimum resistance to the operator in changing the tap position to prevent erratic or unwanted momentary connect and disconnect operations. In tis regard it is desirable to provide a switch which minimizes the force required to change tap positions, is mechanically stable in a selected position but is capable of rapid movement from one position to another to minimize arcing and interruption of power to the driven load. Accordingly, it is important to minimize unwanted forces acting on the movable contactors such as magnetic forces caused by current flow through the contact elements. Moreover, a smooth contact movement between tap positions together with a positive "snap-over" action is important.

It is also important to provide a tap changing switch which is positively lockable in a selected position and is difficult or impossible to inadvertently move between tap positions. Other considerations which must be dealt with include providing the switch structure with sufficient dielectric strength to prevent arcing or short circuiting and to permit access to the contact terminals for connecting and disconnecting the transformer winding leads from the transformer. All of these desiderata are difficult to satisfy with a switch design which is economical to manufacture and reliable in operation. However, the present invention provides a switch which meets the requirements which have been identified in the art but which have heretofore not been satisfied by a suitable switch structure.

SUMMARY OF THE INVENTION

The present invention provides an improved transformer switch particulaly adapted for changing tap positions to provide multiple selected secondary voltages in various applications and, in particular, applications for driving downhole well pumps and the like.

In accordance with one aspect of the present invention there is provided a transformer tap changing switch having a plurality of spaced apart stud or rod type switch contacts which are arranged in an arcuate pattern and are operable to be engaged by a rotary contactor having spaced apart roller contactor elements supported in respective arms which are connected to a central shaft portion whereby the rotary contactor may be positively moved between contact positions with a snap action and with moderate mechanical effort.

In accordance with another aspect of the present invention there is provided a multiposition switch particularly adapted for transformer tap changing applications wherein a plurality of stationary rod type contacts are provided with centrally disposed connector terminals for connection to the transformer winding leads. The rod type switch contacts are arranged with respect to at least two spaced apart roller type contactors for interconnecting adjacent rod contacts in such a way that the current paths through the contacts are divided and magnetic forces generated by current flow are substantially cancelled or balanced to minimize their effect on actuation of the switch. The divided flow path of current also reduces arcing during contactor movements and thus improves switch life and reduce hazardous operating conditions.

In accordance with still further superior aspects of the present invention the improved tap changing switch is provided with a manual actuating lever which is positively lockable in a predetermined contact engaging position to prevent inadvertent movement of the switch contactor and to minimize erratic operation and reengagement of switch contacts during initial movement of the movable contactor structure. The general arrangement of the switch structure also improves its dielectric properties as regards suitable spacing of the contact elements from structure which might result in unwanted arcing or short circuiting. The particular arrangement of the rod contacts and the supporting structure therefor is easily accessible with regard to connection and disconnection of the transformer winding leads to the respective rod contact terminals. The contact rods themselves form support structure for interconnecting spaced apart support plates for the rod contacts and a rotary contactor shaft.

The abovedescribed features and advantages of the present invention as well as additional superior aspects thereof will be further appreciated by those skilled in the art upon reading the detailed description which follows in conjunction with the drawing.

DESCRIPTION OF THE PREFERRED EMBODIMENT

Figure 1:
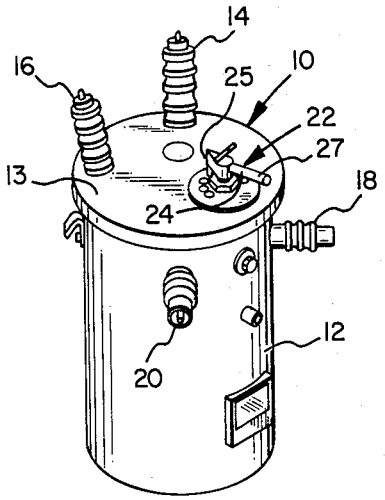
FIG. 1 is a perspective view of a transformer including the improved tap changing switch of the present invention.

In the description which follows like parts are marked throughout the specification and drawing with the same reference numerals, respectively. The drawing is not necessarily to scale and certain features of the invention may be exaggerated in scale or shown in somewhat schematic form in the interest of charity and conciseness.

Referring to FIG. 1, there is illustrated an electrical transformer, generally designated by the numeral 10, which is adapted to utilize an improved single phase tap changing switch in accordance with the present invention. The transformer 10 is of a type particularly adapted for deepwell pumping applications operating in nominal KVA sizes of 25 to 150. The transformer 10 includes a generally cylindrical housing 12 in which a core and winding, not shown, are disposed. Spaced apart primary terminals 14 and 16 extend from the top of the housing 12 and spaced apart secondary terminals 18 and 20 project from the sidewall of the tank type housing. The transformer 10 is of a type which is adapted to be filled with an insulating and cooling oil so that substantially all components within the housing 12 are immersed in the oil. The transformer 10 includes an improved tap changing switch, generally designated by the numeral 22 in FIG. 1, which has a manually actuatable tap changing handle 24 extending from the housing top wall 13 and adapted for manual actuation to change the tap connections and, accordingly, the secondary supply voltage of the transformer 10. The handle 24 includes an integral nose part 25 and an actuating lever 27. The specific location of the switch on the transformer housing 12 may vary and is shown in the position illustrated in FIG. 1 primarily for convenience.

Figure 2:
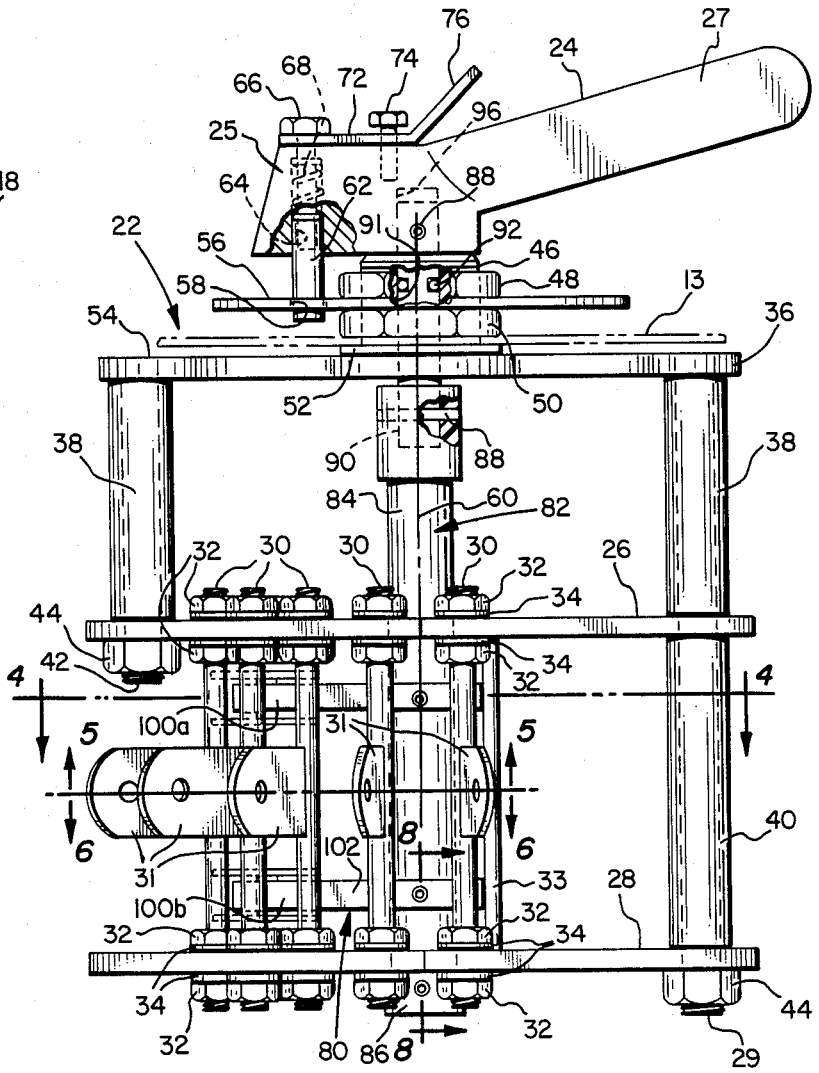
FIG. 2 is a longitudinal side view, partially sectioned, of the transformer tap changing switch of the present invention.
Figure 3:
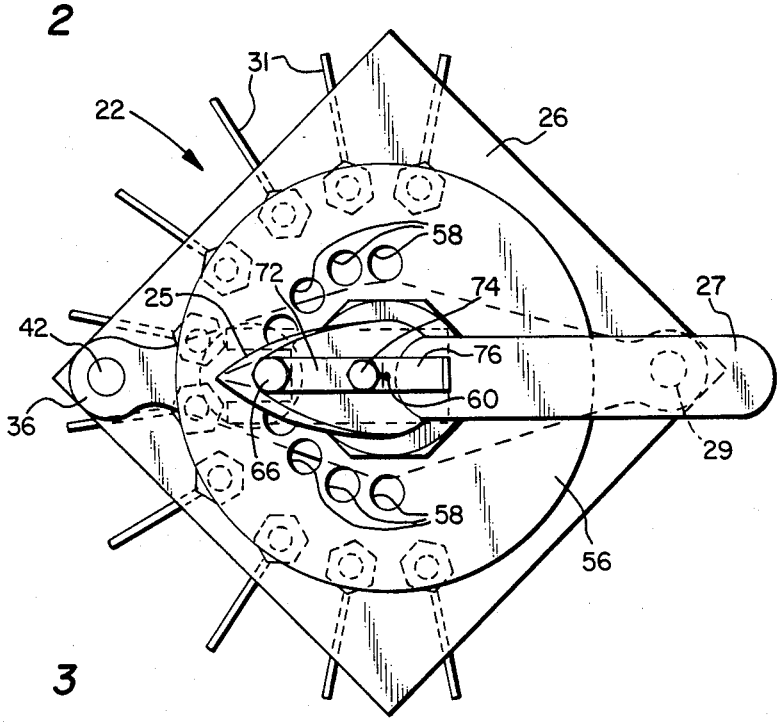
FIG. 3 is a top end view.
Figure 4:
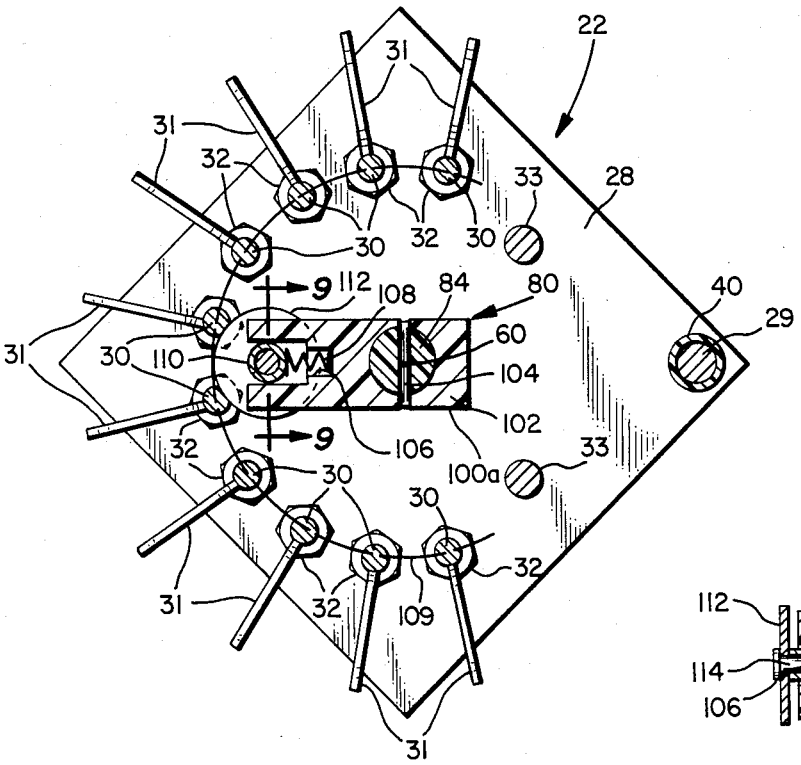
FIG. 4 is a section view taken from the line 4—4 of FIG. 2.
Figure 9:
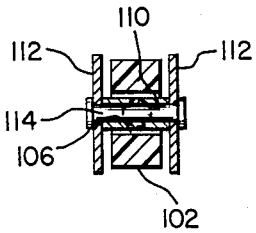
FIG. 9 is a detail section view taken from the line 9—9 of FIG. 4.

Referring now to FIGS. 2, 3 and 4, the tap changing switch 22 is characterized by a support frame structure comprising a pair of spaced apart generally rectangular plates 26 and 28 which are interconnected by an elongated stud 29 and a plurality of elongated cylindrical copper rod contact elements 30. The rod contact elements 30 are each threaded on their opposite ends and are secured in assembly with the respective plates 26 and 28 by opposed sets of cooperating nuts 32 and lock washers 34, selected ones of which are designated in the drawing figures. The plate 26 is also connected to a support member 36 by the stud 29 which is anchored at one end to the support member and extends through spacer sleeves 38 and 40 interposed, respectively, between the support member 36 and the plate 26 and between the plates 26 and 28. The support member 36 and the plate 26 are also secured together by a nylon stud 42 extending through a second spacer sleeve 38 and threadedly engaged with a nut 44. The stud 29 is also held in assembly with the support member 36 and the plates 26 and 28 by a nut 44 threaded over the distal end of the stud 29. The support member 36 and the plate 26 are maintained suitably spaced apart by the spacer sleeves 38 which are made of a suitable laminated plastic or other dielectric material. The plates 26 and 28 are made of a suitable dielectric material such as reinforced plastic.

As shown in FIG. 2, the support member 36 includes a generally cylindrical packing gland 46 extending therefrom and centrally positioned between the points of connection of the studs 29 and 42 to the support member. The packing gland 46 is externally threaded to receive locknuts 48 and 50, and a suitable gasket 52 is disposed thereover and bearing against a surface 54 of the support member 36. The packing gland 46 is adapted to extend through the wall 13 of the housing 12, a portion of which wall is illustrated in FIG. 2, and the switch 22 is secured in sealing engagement with the wall 13 by way of the gasket 52 and the locknut 50 which secures the switch 22 to the tank wall.

The packing gland 46 is also adapted to support between the locknuts 48 and 50 a part of a switch position locking mechanism comprising a circular plate 56 having a plurality of detent holes 58 formed therein along a circular arc having a radius center at the axis 60. The position lock plate 56 is cooperable with a retractable lock pin 62 supported on the handle nose part 25 as illustrated in FIG. 2. The pin 62 is retained in a suitable bore 64 formed in the nose part 25 by a hex head screw 66 threadedly engaged with one end of the pin 62 and extending through a coil spring 68 trapped in the bore 64 between one end of the pin and a shoulder formed in the bore. A pin actuating trigger 72 is loosely retained on the handle 24 by a screw 74 which is threaded into a blond hole in the handle and is of sufficient length to permit digital actuation of a rocker portion 76 to effect retraction of the pin 62 from one of the selected holes 58 so that the handle 24 may be rotated about the axis 60.

Figure 8:
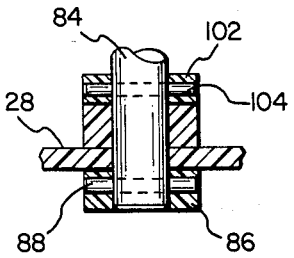
FIG. 8 is a detail section view taken along line 8—8 of FIG. 2.

The switch 22 is provided with a unique rotary contactor assembly, generally designated by the numeral 80, and comprising an elongated cylindrical shaft assembly 82 connected to the handle 24 for rotation in response to rotation of the handle itself. The shaft assembly 82 includes a shaft section 84 made of suitable dielectric material such as reinforced plastic and which is journaled in cooperating bores formed in the plates 26 and 28. One end of the shaft section 84 extends through the plate 28, as shown in FIG. 8, and is provided with a thrust collar 86 suitably keyed to the shaft section 84 with a slotted or spiral wrapped tubular pin type retainer 88. Referring to FIG. 2, the shaft section 84 is also connected to a second shaft section 90 by a pin retainer 88 and the shaft section 90 extends through a bore 91 in the packing gland 46. The shaft section 90 is preferably provided with a circumferential groove for supporting an O-ring type seal 82 cooperable with the bore 91 of the packing gland to prevent leakage of fluid into or out of the transformer 10. The shaft section 90 also extends into a bore 96 formed in the handle 24 and is suitably keyed to the handle for rotation therewith by a pin retainer 88.

Referring also to FIGS. 4, 5, 6 and 9, the shaft section 84 is adapted to support a pair of spaced apart rotary switch contactors generally designated by the numerals 100*a* and 100*b*. The switch contactors 100*a* and 100*b* include respective support arms 102 which extend radially from and are supported on the shaft section 84 and are keyed to the shaft section 84 for rotation therewith by pin type retainers 104 similar to the pin retainers 88. As shown by way of example in FIGS. 4 and 9, each of the support arms 102 is provided with a recess 106 in which is disposed a coil spring 108. The coil spring 108 bears against a cylindrical bushing 110 which is adapted to support two spaced apart cylindrical disk or roller type contactor elements 112 which are interconnected by a shaft portion 114 disposed in and extending through the bushing 110. The roller contactors 112 are disposed on opposite sides of the support arms 102, respectively, and are yieldably biased into engagement with a pair of adjacent ones of the rod contact elements 30 by the respective coil springs 108.

Figure 7:
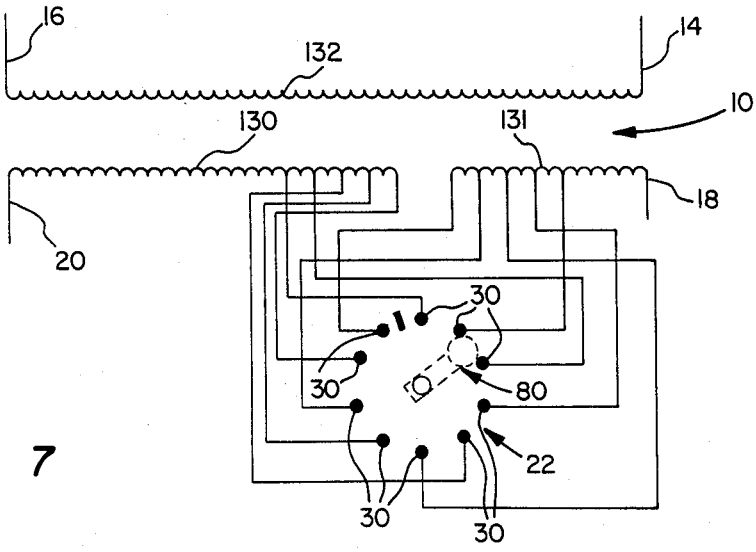
FIG. 7 is a schematic diagram of a typical connection of the switch to a transformer having multiple secondary winding taps.

As indicated in FIG. 4, the rod contact elements 30 are preferably spaced apart equally on a circular arc 109 having its center at the axis 60. Although a total of ten rod contact elements 30 are shown for the switch 22 any number greater than two may be utilized in a switch enjoying the benefits of the present invention. The switch 22 is also provided with two stops 33 comprising elongated bolts extending between the plates 26 and 28 and operable to prevent movement of the switch contactors 100*a* and 100*b* past opposed limit positions wherein the contactors 112 are engaged with two adjacent contacts 30 are opposite ends of the contact circle. The rod contacts 30 are each provided with a radially outwardly projecting bladelike lug or terminal 31 for connecting each of the rod contacts to a conductor lead, not shown, connected also to one of the aforementioned transformer windings. A typical transformer circuit connection for the switch 22 is illustrated in FIG. 7.

As shown in FIG. 2, the terminals 31 are substantially equally spaced from the support plates 26 and 28 and also are substantially centrally positioned between the spaced apart roller contactor assemblies 100*a* and 100*b*. In accordance with an important aspect of the present invention the position of the conductor terminals 31 for the rod contacts 30, the relative positions of the contactors 100*a* and 100*b* and the configuration of the contact elements essentially balances or eliminates adverse effects of magnetic forces acting on the contactors 100*a* and 100*b* and their support structure. By spacing the contactors 100*a* and 100*b* along the rod contacts 30 a finite distance from and on opposite sides of the terminals 31 current flowing from one rod contact to the adjacent rod contact through one of the contactors 100*a* or 100*b* is forced to flow along the portions of the rod contacts 30 between the terminal 31 and the ruller contactors 112 whereby generally circular magnetic force fields in accordance with the "right hand rule" are established which bias the contactor assembly 100*a* or 100*b* to move the contactor in one direction or the other depending on the direction of current flow. However, the current flowing to and from the other of the contactors 100*a* or 100*b* along the respective rod contact portions between the contactor assembly and the terminal 31 will result in generation of generally circular magnetic force fields in the opposite direction thereby substantially cancelling or balancing the effect of the force fields generated by the current flowing to and from the first contactor. The improved arrangement for cancelling or balancing electromagnetic forces can be significant in applications such as the well pump application wherein high starting and switching currents are experienced.

Figure 5:
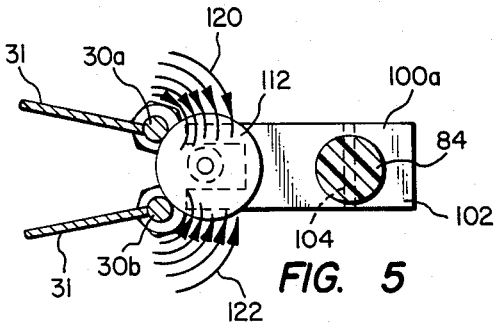
FIG. 5 is a detail section view taken from the line 5—5 of FIG. 2.
Figure 6:
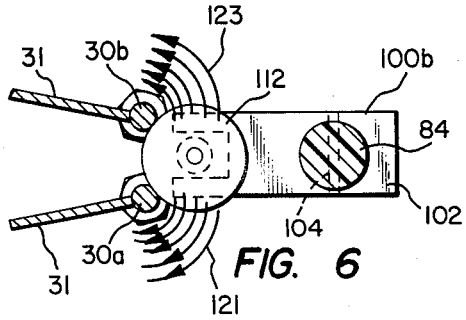
FIG. 6 is a detail section view taken from the line 6—6 of FIG. 2.

FIG. 5 illustrates, for example, an arrangement wherein current is flowing from the contact element 30*a* to the contact element 30*b* through the contactor 100*a* as would be seen when viewing FIG. 5. In FIG. 5, the magnetic force lines are indicated by the numerals 120 and 122, respectively for the magnetic field generated by current flowing thrugh the respective rod contacts 30*a* and 30*b*. As will be noted, the direction of the force lines 120 and 122 bias the contactor 100*a* in the position shown when the shaft 84 is rotated in either direction since movement of the contactor in either direction causes the contactor to enter into either the field represented by the lines 120 or 122 and away from the other field. Both fields tend to move the contactor back into engagement with contacts 30*a* and 30*b*. In the same manner, viewing FIG. 6, the direction of current flow through the rod contacts 30*a* and 30*b* between the terminals 31 and the contactor assembly 100*b* also generates opposing magnetic force fields represented by lines 121 and 123 which bias the contactor 100*b* in the direction in which it is being moved. Accordingly, the magnetic forces acting on contactor 100*a* are substantially balanced or negated by the magnetic forces acting on contactor 100*b* and have negligible effect on the effort to rotate the contactor shaft 82 and the contactor assemblies 100*a* and 100*b* from one position to the next switch position when switching or changing transformer taps under load. Another advantage of the arrangement of the rod contacts 30 and the roller contactors 112 is that the current path from one contact 30 to the other is divided substantially evenly between four rollers contactors 112 so that any tendency for arcing and damage to the contact elements when changing switch positions is somewhat reduced.

Those skilled in the art will appreciate from the foregoing description that the arrangement of the rod contacts 30 and the centrally positioned terminals 31 together with the spaced apart roller contactor assemblies 100*a* and 100*b* provides a reliable tap changing switch which requires a modest turning effort of the contactor shaft 82 while yet maintaining positive engagement of the contactor assemblies with the intended pair of rod contacts 30 which are to be electrically interconnected. Thanks to the arrangement of the roller contactors 100*a* and 100*b*, upon rotation of the shaft 82, the contactors move away from one or the other rod contact elements 30 in a positive manner with relatively rapid separation and with substantial distance established between the roller contactors 112 and a rod contact 30 being separated from the roller contactors with relatively minor initial movement of the handle 24. Accordingly, when changing tap positions under load the duration of the switching arc is reduced or minimized. This is somewhat dependent on the speed with which the handle 24 is rotated, however, under normal operation of the handle the contactor assemblies 100*a* and 100*b* are quickly and positively indexed from one tap position to the next to minimize arc generation and duration. Those skilled in the art will also appreciate that the configuration of the spriing biased roller contactors 112 provides for a positive positioning of the switch in a particular tap connecting position even though a positive switch position locking mechanism is provided by the pin 62 and the cooperating position locking plate 56.

The improved switch design embodied in the switch 22 is also realized with the particular configuration of the contactor section of the switch which is spaced within the transformer housing a sufficient distance from the wall 13. For a tap changing switch having the load handling capability for a transformer of the rating in the range indicated above for the transformer 10, the switch may be physically dimensioned to provide a space or distance between the support plate 26 and the support member 36 of approximately 3 inches. The rod contact elements 30 are preferably spaced on a circular arc or bolt circle 109 having its center at the axis 60 and having a radius of approximately 2.60 inches. The rod contacts 30 are preferably spaced apart approximately 1.0 inches and the diameter of the roller contactors 112 is approximately 1.40 inches. The diameter of the rod contact elements is a nominal 0.35 inches.

FIG. 7 illustrates a circuit diagram showing the arrangement of the switch 22, indicated schematically in the drawing figure, in circuit with secondary windings 130 and 131 of the transformer 10 having also a primary winding 132. As indicated by the circuit diagram of FIG. 7, the switch position may be changed to interconnect varying amounts of the secondary windings to alter the secondary supply voltage at the terminals 18 and 20. The terminals 18 and 20 are typically connected directly to a load such as induction motor, not shown, in an application such as the aforementioned deepwell pump application. As previously discussed, the switch 22 may be easily adjusted from one position to another by grasping the handle 24 and retracting the locking pin 62 through digital actuation of the trigger 72 whereby a modest turning effort sans any effect of magnetic forces acting on the contactors 100*a* and 100*b* may be utilized to move the switch from one position to the next. Once the contactor shaft 82 has moved sufficiently to prevent extension of the pin 62 into the one of the pin receiving locking holes 58, the trigger 72 may be released so that, with continued rotation of the handle 24, the pin 62 will automatically drop into the next locking hole as the contactor shaft is rotated.

Those skilled in the art will also appreciate that the switch 22 may be easily assembled and disassembled for servicing, is of rugged construction, and provides several advantages in the art of tap changing switches for electrical transformers and the like. Although a preferred embodiment of the present invention has been described in detail herein those skilled in the art will recognize that various substitutions and modifications may be made to the specific embodiment described without departing from the scope and spirit of the invention as recited in the appended claims.

What I claim is:

1. A tap changing switch for an electrical transformer for connecting and disconnecting selected portions of a transformer winding under load to change the output supply voltage of said transformer, said switch comprising:

frame means for supporting a plurality of spaced apart contact elements, each of said contact elements including a terminal portion thereof disposed between opposite ends of said contact element for connecting said contact element to a conductor lead associated with a transformer winding;

rotary shaft means rotatably mounted on said frame means and connected to two spaced apart switch contactor means for engaging a selected pair of contact elements to close a circuit through said winding, said spaced apart contactor means being disposed on opposite sides of said terminal portions of said selected pair of contact elements, respectively, when engaged with said selected pair of contact elements so as to negate magnetic forces generated by current flow through said contact elements and said contactor means and acting on said contactor means during disengagement from said selected pair of contact elements.

2. The switch set forth in claim 1 wherein:

said contactor means comprises at least first cylindrical roller means rotatably mounted on a first arm projecting radially outward from said shaft means, said first roller means being engageable with said selected pair of contact elements at a position on said selected pair of contact elements spaced from said terminal portions of said selected pair contact elements, respectively.

3. The switch set forth in claim 2 wherein:

said contactor means comprises second roller means mounted on a second arm projecting radially from said shaft means and engageable with said selected pair of contact elements at a position spaced from said terminal portions of said selected pair of contact elements, respectively.

4. The switch set forth in claim 3 wherein:

said first and second roller means are yieldably biased into engagement with said contact elements by spring means mounted on said arms, respectively.

5. The switch set forth in claim 4 wherein:

said contact elements comprise a plurality of elongated cylindrical rods disposed substantially parallel to each other and spaced apart along a circular arc about said shaft means, said shaft means being rotatable to move said contactor means between selected positions of engagement with a pair of adjacent ones of said rods for electrically interconnecting selected portions of said winding.

6. The switch set forth in claim 5 wherein:

said terminal portions comprise lugs secured to said rods between said contactor means.

7. The switch set forth in claim 5 wherein:

said rods are secured to spaced apart plate members of said frame means, said plate members supporting said shaft means for rotation of said contactor means with respect to said rods.

8. The switch set forth in claim 7 wherein:

said frame means includes a support member connected to one of said plate members and spaced therefrom by means formed of a dielectric material, said support member including means for securing said switch to a portion of a tank wall of said transformer.

9. A tap changing switch for an electrical transformer for connecting and disconnecting selected portions of a transformer winding under load to change the output supply voltage of said transformer, said switch comprising:

frame means for supporting a plurality of spaced apart contact elements, each of said contact elements including a terminal portion aligned with a corresponding terminal portion on every other contact element for connecting each of said contact elements to a conductor lead associated with a transformer winding;

rotary shaft means rotatably mounted on said frame means and connected to switch contactor means for engaging a selected pair of contact elements to close a circuit through said winding;

said contactor means comprising first and second contactors spaced apart from each other on opposite sides of said terminal portions whereby current flowing to and from said contactors between said contact elements flows in opposite directions along portions of said contact elements, respectively, between said terminal portions of the respective contact elements to generate magnetic force fields acting on one of said contactors which are opposite to the magnetic force fields acting on the other of the contactors.

10. The switch set forth in claim 9 wherein:

said contact elements comprise a plurality of elongated cylindrical rods disposed substantially parallel to each other and spaced apart along a circular arc about said shaft means, said shaft means being rotatable to move said contactors between selected positions of enagagement with a pair of adjacent ones of said rods for electrically interconnecting selected portions of said winding.

11. A switch for connecting and disconnecting selected portions of a transformer winding or the like, said switch comprising:

a frame including a pair of spaced apart frame plates;

a plurality of elongated switch contact elements extending between and secured to said frame plates; respectively, said contact elements being arranged spaced apart along a circular arc having a central axis;

each of said contact elements having a terminal portion disposed between said frame plates;

rotary shaft means mounted on said frame and rotatable about said axis;

contactor means mounted on said shaft means spaced apart on opposite sides of said terminal portions of said contact elements and engageable with adjacent ones of said contact elements for interconnecting portions of a transformer winding, said contactor means being movable in response to rotation of said shaft means to be selectively positioned in engagement with a selected pair of adjacent ones of said contact elements for supplying a selected voltage across output terminals of said transformer.

12. The switch set forth in claim 11 wherein:

said contactor means includes a pair of arms mounted spaced apart on said shaft means and extending radially from said shaft means, at least one roller contactor mounted on respective ones of said arms and engageable with said contact elements, and means for yieldably biasing said roller contactors into engagement with said contact elements whereby said shaft means may be rotatably indexed to selectively interconnect a pair of adjacent ones of said contact elements.

13. The switch set forth in claim 12 wherein:

said contactor means includes two roller contactors rotatably supported on said arms, respectively, by respective shafts supporting said two roller contactors spaced apart one from the other, and said means for yieldably biasing said roller contactors includes spring means supported on said arms, respectively, and engageable with respective bushing means rotatably journalling said shafts.

14. The switch set forth in claim 11 including:

a support member spaced from and connected to one of said frame plates, said support member including a portion for journalling a part of said shaft means and adapted to form a fluid-tight seal between said shaft means and said support member, said portion of said support member being adapted to extend through a wall of a transformer and threadedly engageable with a nut for mounting said switch on said wall.

15. The switch set forth in claim 14 wherein:

said shaft means extends through said portion of said support member and is connected to handle means for rotating said shaft means.

16. The switch set forth in claim 15 including:

position lock means comprising a plate supported on said support member and including detent forming means cooperable with a retractable pin mounted on said handle means and engageable with said plate to lock said shaft means in a selected position of said shaft means and said contactor means.

17. The switch set forth in claim 11 wherein:

said terminal portions comprise terminal lugs connected to said contact elements, respectively, and projecting radially outward with respect to said axis.

* * * * *